US005102102A

United States Patent [19]

Hidaka et al.

[11] Patent Number: 5,102,102

[45] Date of Patent: Apr. 7, 1992

[54] APPARATUS FOR CONTROLLING OPERATING REACTION OF WINCH

[75] Inventors: Sachio Hidaka, Kakogawa; Yoshiaki Fujimoto, Himeji, both of Japan

[73] Assignee: Kabushiki Kaisha Kobe Seiko Sho, Kobe, Japan

[21] Appl. No.: 584,380

[22] Filed: Sep. 18, 1990

Related U.S. Application Data

[63] Continuation of Ser. No. 317,996, Mar. 2, 1989, abandoned.

[30] Foreign Application Priority Data

Mar. 3, 1988 [JP] Japan ..... 63-50015

[51] Int. Cl.[5] ..... B66D 1/58

[52] U.S. Cl. ..... 254/266; 91/361; 91/461

[58] Field of Search ..... 91/361, 461; 254/361, 254/266

[56] References Cited

U.S. PATENT DOCUMENTS

| | | | |
|---|---|---|---|
| 2,591,871 | 4/1952 | Richolt . | |
| 2,947,285 | 8/1960 | Baltus | 91/361 |
| 3,568,572 | 3/1971 | Steinmetz | 91/361 X |
| 3,685,290 | 8/1972 | Krusche | 91/461 X |
| 3,739,813 | 6/1973 | Worden . | |
| 3,805,674 | 4/1974 | Sebesta | 91/461 |
| 3,995,831 | 12/1976 | Spanski et al. . | |
| 4,753,158 | 6/1988 | Hirata | 91/461 |

FOREIGN PATENT DOCUMENTS

| | | |
|---|---|---|
| 2152133 | 2/1973 | Fed. Rep. of Germany . |
| 2158124 | 6/1973 | France . |
| 62-14077 | 4/1987 | Japan . |

*Primary Examiner*—Katherine Matecki

*Attorney, Agent, or Firm*—Oblon, Spivak, McClelland, Maier & Neustadt

[57] ABSTRACT

An apparatus for controlling operating reaction of winch comprising a reaction device whose output is variable for applying the output as an operating reaction to an operating lever of a winch, load detection means for detecting a lifting load of the winch, lever operating amount detection means for detecting an operating amount of said operating lever, and a controller for indicating an output having a value corresponding to the lifting load and the lever operating amount to said reaction device on the basis of the detection amount by said load detection means and said lever operating amount detection means.

4 Claims, 2 Drawing Sheets

APPARATUS FOR CONTROLLING OPERATING REACTION OF WINCH

This application is a continuation of application Ser. No. 07/317,996, filed on Mar. 2, 1989, now abandoned.

BACKGROUND OF THE INVENTION

1. Field of the Invention

The present invention relates to an apparatus for controlling operation reaction which controls the magnitude of an operating reaction of a winch such as a crane.

2. Prior Art

Means for controlling the magnitude of an operating reaction of an operating lever according to a lifting load is well known as disclosed in Japanese Utility Model Publication NO. 3976/1983, in which a load pressure of an actuator (hydraulic motor) acting on a spool of a direction control valve is fed back to an operating valve operated by an operating lever to thereby apply an operating reaction corresponding to the lifting load to the operating lever.

In addition, means is well known as disclosed in Japanese Utility Model Publication No. 14077/1987, in which reaction devices each comprising an expansion cylinder and a spring provided at the end of a rod of the expansion cylinder are arranged symmetrically on opposite sides in an operating direction of an operating lever, the expansion cylinder being extended according to a lifting load detected by a load detector to bring the spring into contact with the operating lever so as to obtain an operating reaction by the force of the spring.

However, in any of the aforementioned prior art, only the lifting load is used as the condition for deciding the reaction, and the reaction is decided irrespective of the extent of the lever operating amount. Therefore, for example, in the inching work in which the lever is operated with a small operating amount in order to mincingly wind up a lifting load, the same reaction as that of normal winding-up work acts, thus making the operation difficult, resulting in a poor operability. Despite the act that the winch load is determined by the lifting load and the winding-up speed lever operating amount), the aforesaid system for detecting only the winch load has a drawback in that proper reaction control according to the winch load cannot be achieved.

SUMMARY OF THE INVENTION

It is therefore an object of the present invention to provide a reaction control apparatus for a winch which can perform a proper reaction control according to a lever operating amount.

In accordance with the present invention, there is provided an apparatus for controlling operating reaction of a winch comprising a reaction device whose output is variable for applying the output as an operating reaction to an operating lever of a winch, load detection means for detecting a lifting load of the winch, lever operating amount detection means for detecting an operating amount of said operating lever, and a controller for indicating an output having a value corresponding to the lifting load and the lever operating amount to said reaction device on the basis of the detection amount by said load detection means and said lever operating amount detection means.

With the above described structure, since reaction is decided according to the lifting load and the lever operating amount, the operatability is good, and the proper reaction control corresponding to the winch load can be carried out.

DESCRIPTION OF THE PREFERRED EMBODIMENT

A first embodiment of the present invention is shown in FIGS. and 2.

Figure 1:
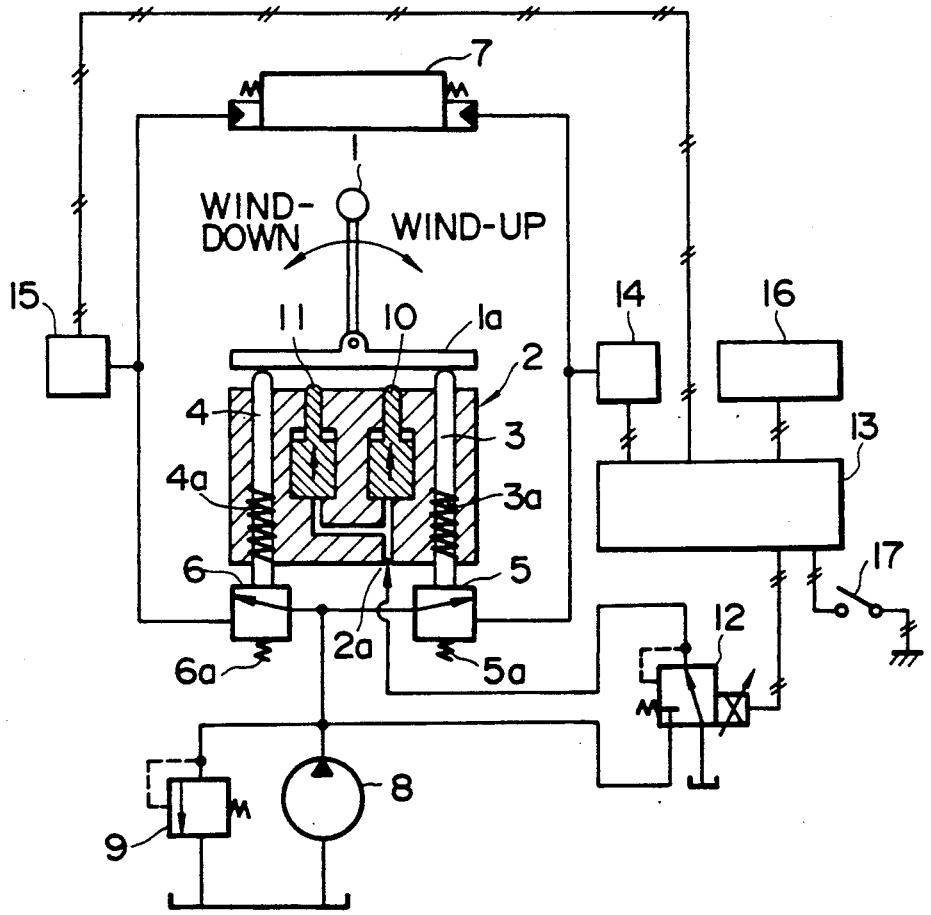
FIG. 1 is a view showing the structure of a reaction control apparatus according to a first embodiment of the present invention.

Referring to FIG. 1, by operating an operating lever indicated at 1, one of the push rods 3 or 4 provided on the winding up side and winding down side, respectively, in an operating valve Z is pushed down by an operating plate 1*a*. Both pilot reducing valves 5 and 6 on the winding up side and winding down side, respectively, are arranged below both the push rods 3 and 4. The reducing valve 5 or 6 on the side corresponding to the pushed down push rod is opened in an opening degree according to the lever operating amount and a control valve (direction control valve) 7 is actuated by a secondary pressure thereof for accomplishment of winding up or winding down work. The reference numeral 8 designates a pump; 9, a relief valve; 3*a*, 4*a*, return springs of the push rods 3, 4; and 5*a*, 6*a*, push springs of the reducing valves 5, 6.

The operating valve 2 has reaction pistons 10, 11 on the winding up side and winding down side, respectively, which are vertically slidably mounted in line with the push rods 3 and 4. The reaction pistons 10, 11 are moved upward while being supplied with a secondary pressure of an electromagnetic proportional reducing valve 12 connected to the pump 8, and when the lever is operated, the end thereof comes into contact with the lower surface of the operating plate 1*a* to apply an operating reaction (which is the force adapted to push back the lever 1 toward a neutral position) to the operating lever 1. That is, the reaction pistons 10, 11 and the electromagnetic proportional reducing valve 12 constitute a reaction device whose output is variable. The piston rods 10, 11 have strokes set such that the end thereof in the maximum up state comes into contact with the lower surface of the plate 1*a* in the lever neutral state in the state wherein contact pressure is zero so that reaction is not applied when the lever is in a neutral position but reaction is applied simultaneously with the commencement of the lever operation. The reference numeral 2*a* designates an oil passage for guiding a secondary pressure (pressure oil) of the electromagnetic proportional reducing valve 12 to a portion below the reaction pistons 10 and 11 in the operating valve 2.

The secondary pressure of the electromagnetic proportional reducing valve 12 is controlled by an output current from the controller 13. The back pressure of the reaction pistons 10, 11 act as an operating reaction with respect to the operating lever 1, so that the output of the reaction device is controlled.

Detection values by pressure sensors 14, 15 and load detector 16 are input into the controller 13.

The pressure sensors 14 and 15 detect the secondary pressure of the pilot reducing valves 5, 6 as the lever operating amount, which is converted into an electric amount to output it to the controller 13. On the other hand, the load detector 16 detects the lifting load of winch as an electric amount. The load detector 16 uses a load cell for detecting a tension of a winding up rope as a lifting load, or a pressure sensor for detecting pressure of a hinged boom cylinder.

Alternatively, the load detection means comprises means for detecting load pressure of an actuator (hydraulic motor) by the lever operation to indirectly detect a lifting load. However, this means has a drawback in that in the case where the lifting load is wound up from its lifting state, the operating lever is operated and the actuator is then actuated and the operating reaction is applied for the first time when a lifting load is actually moved, and therefore a delay in response from the commencement of the lever operation occurs. Therefore, it is desirable that means in which a lifting load is directly detected by means of a load cell, as described above, is used. An operating reaction value (output current value to the valve 12) as required is obtained on the basis of the lifting load, and a reaction value command corresponding to a lever stroke is output so that the thus obtained reaction value may assume a value (maximum reaction value) at the stroke end of the operating lever 1.

With the above described arrangement, when the operating lever 1 is operated from the neutral position to the winding-up side, for example, the pilot reducing valve 5 on the winding-up side is pushed and opened by the push rod 3 on the winding-up side, and the control valve 7 is actuated by the pilot pressure to start winding-up work. At that time, the pilot pressure of the pilot reducing valve 5 is detected by the pressure sensor 14 and input as the detection value of the lever operating amount to the controller 13. At that time, the lifting load has been already detected by the load detector 16 and the detection value has been input into the controller 13.

The controller 13 outputs the command of the lifting load and the reaction value corresponding to the lever operating amount to the electromagnetic proportional reducing valve 12, and the reaction piston 10 on the winding-up side is moved upward by the secondary pressure of the reducing valve 12 to contact the operating plate la thereby applying the operating reaction to the operating lever 1. At that time, the reaction piston 11 on the winding-down side is simultaneously moved upward. However, since the stroke of the piston is set so that even in the maximum up state, it will not extend upwardly of the operating plate 1*a* in its neutral position, the operating lever 1 is not affected by the reaction piston 11 on the winding-down side.

In this manner, the operating reaction according to the lifting load and the lever operating amount is applied to the operating lever 1. For example, at the time of the inching work in which the lever operating amount is small, the operating reaction is small to render operation easy, and the operability is good. In the case where the lever operating amount is large (the winding up speed is high), the operating reaction is large to suppress the lever speed. Thus, the proper control according to the winch load can be made.

Figure 2:
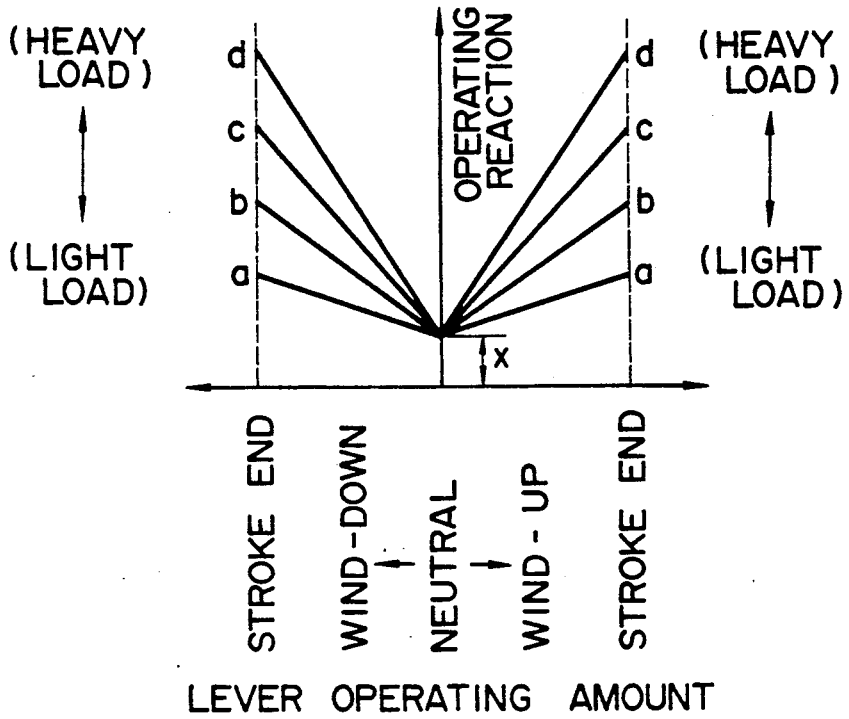
FIG. 2 shows a control characteristic according to the apparatus.

One example of the control characteristic obtained by the apparatus is shown in FIG. 2, in which case, the operating reaction is linearly varied proportional to the lever operating amount. In the figure, the straight line a indicates the variation of the operating reaction in the state of the lightest load As the load increases, the maximum value of the operating reaction increases as shown by the straight lines b to d, and as the lever operating amount increases, the reaction value increases. The reference character x represents the reaction in the neutral state caused by return springs 3*a*, 4*a* of the push rods 3, 4 and push springs 5*a*, 6*a* of the pilot reducing valves 5, 6, respectively.

Since such reaction control is electrically processed by the controller 13, the control characteristic can be suitably selected according to the work conditions or the like. For example, it is possible to effect controlling such that even at the light load, a large operating reaction acts, or controlling such that when the lever operating amount is small, the start-up of reaction is made large, and thereafter a fixed reaction is maintained. On the other hand, it can he set so that the aforesaid reaction in the neutral state is set to be very small, and at the inching work in which the lever operating amount is small, the operating reaction is smaller.

In FIG. 1, the reference numeral 17 designates a selection switch provided on a power source circuit of the controller 13. At the time when the lever is often operated or the like, in which case the control of the operating reaction is not required, the selection switch 7 can be turned off to stop the operation of the control apparatus.

Figure 3:
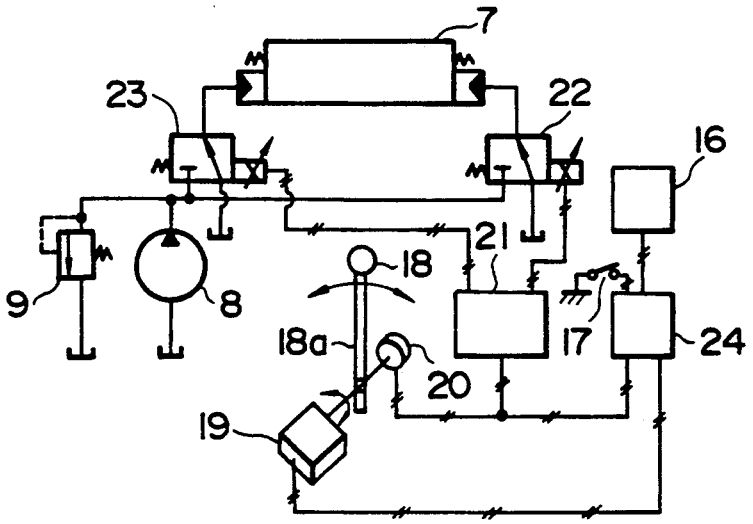
FIG. 3 is a view showing the structure of a reaction control apparatus according to a second embodiment of the present invention.

A second embodiment is shown in FIG. 3.

In the second embodiment shown in FIG. 3, in a winch control apparatus of a system in which the operating amount of an operating lever 18 is detected to control a control valve 7, there is used a motor (normally, a dc motor) in place of a combination of the reaction pistons 10, 11 and the electromagnetic proportional reducing valve 12, as a reaction device, used in the aforementioned first embodiment.

More specifically, the reference numeral 20 designates a potentiometer for detecting an operating amount of the operating lever 1. Output of the potentiometer 20 is input into one of electromagnetic proportional reducing valves 22 and 23 on the winding-up side and winding-down side, respectively, corresponding to the pilot reducing valves 5 and 6 in the first embodiment via a main controller 21 for controlling a control valve, whereby the control valve is actuated to effect the winding-up or winding-down work.

Output of the potentiometer 20 is also sent to a controller 24 for controlling reaction so that electric output according to a lifting load and a lever operating amount is supplied as a command of a rotational direction and a rotational torque to the motor 19 on the basis of the detection value of the lever operating amount and the load detection value caused by the load detector 16 similar to that of the first embodiment.

This motor 19 is mounted in the state wherein the rotational shaft thereof is connected to a lever shaft 18*a* of an operating lever 18, and the rotational torque of the motor 19 acts as an operating reaction of the operating lever 18.

Also in the second embodiment, the operation and effect similar to those of the first embodiment can be basically obtained.

Other Embodiments (1) As the means for detecting a lever operating amount in the first embodiment, the potentiometer used in the second embodiment can be used.

(2) The structure of the second embodiment using the motor 19 as the reaction device can be applied without modification to the case employing the control system which uses the operating lever 1, the operating valve Z with a push rod and the pilot reducing valve 5 and 6 shown in the first embodiment.

(3) In the structure of the first embodiment, independent hydraulic cylinders can be used on the winding-up side and winding-down side in place of the reaction pistons 10 and 11.

As described above, according to the present invention, it is designed so that the lifting load and the operating amount of the operating lever are detected by the detector, and the operating reaction caused by the reaction device is controlled according to the thus detected lifting load and lever operating amount. Therefore, the operability is good, and the proper control according to the winch load can be carried out.

What is claimed is:

1. A winch having an operating reaction comprising:

a means for winding a cable to lift a load;

a power source providing power to said means for winding;

a control valve which comprises means for controlling the power provided to said means for winding;

an operating lever which comprises means for controlling said control valve;

a load detection means for sensing the weight of said load and producing a first output indicative of said weight;

at least one lever operating amount detection means for detecting the movement of said operating lever and providing a second output indicative of said movement;

a controller receiving said first and second outputs and comprises means to produce a third output which is a function of both the load and the movement of the operating lever;

operating reaction means responsive to said third output to provide a reaction force against the movement of the operating lever so as to provide an operator with a feeling of the load and also reduce the reaction force near a rest position of the operating lever to permit small movements of the operating lever without the reaction force.

2. A winch having an operating reaction according to claim 1, wherein said operating reaction means comprises a motor.

3. A winch have an operating reaction according to claim 1, wherein said lever operating amount detection means comprises a potentiometer.

4. A winch having an operating reaction according to claim 1, wherein said operating reaction means includes at least one hydraulic cylinder.

* * * * *